United States Patent [19]

Starke et al.

[11] Patent Number: 4,905,491

[45] Date of Patent: Mar. 6, 1990

[54] UNWIND/REWIND ECCENTRICITY CONTROL FOR ROLLING MILLS

[75] Inventors: Ralf Starke, Louisville, Tenn.; Kenneth C. Markley, Wexford, Pa.

[73] Assignee: Aluminum Company of America, Pittsburgh, Pa.

[21] Appl. No.: 180,173

[22] Filed: Apr. 11, 1988

[51] Int. Cl.[4] ..... B21B 37/06

[52] U.S. Cl. ..... 72/8; 72/10; 72/12; 72/17; 364/472

[58] Field of Search ..... 72/8, 10, 11, 16, 17, 72/19, 28, 12; 364/472

[56] References Cited

U.S. PATENT DOCUMENTS

| | | | |
|---|---|---|---|
| 3,312,091 | 4/1967 | Kobayashi | 72/11 |
| 4,173,133 | 11/1979 | Imai et al. | 72/8 |
| 4,222,254 | 9/1980 | King, Jr. et al. | 72/8 |
| 4,531,392 | 7/1985 | Puda | 72/10 |
| 4,545,228 | 10/1985 | Yamaguti et al. | 72/8 X |
| 4,648,257 | 3/1987 | Oliver et al. | 72/8 X |
| 4,656,854 | 4/1987 | Stewart et al. | 72/8 |
| 4,691,547 | 9/1987 | Teoh et al. | 72/8 X |
| 4,745,556 | 5/1988 | Turley | 72/11 X |

*Primary Examiner*—W. Donald Bray

*Attorney, Agent, or Firm*—Elroy Strickland

[57] ABSTRACT

A method of rolling material in a rolling mill in which the material is directed from an unwind coil of the material to the mill and/or to a rewind coil of the material from the mill, the material being under tension as it is directed to and from the mill. The directing process has at least one cyclic disturbance which ordinarily causes cyclic changes in the tension of the material and in the thickness of the material exiting the mill. The method includes measuring changes in tension and/or thickness, and providing time domain samples of such changes during revolutions of the unwind or rewind coil. The samples are then processed by characterizing them as frequency, magnitude and phase-angle components of the changes using a function that transforms the time domain of the samples into the frequency domain. These components are then emloyed in an update algorithm to provide a current estimate of the cyclic disturbances. The components are then processed by returning them to a time domain value, and using this value to correct for the effects of cyclic change by either controlling the working gap of the mill or the tension of the material in a manner that offsets the occurrence of the cyclic change.

9 Claims, 1 Drawing Sheet

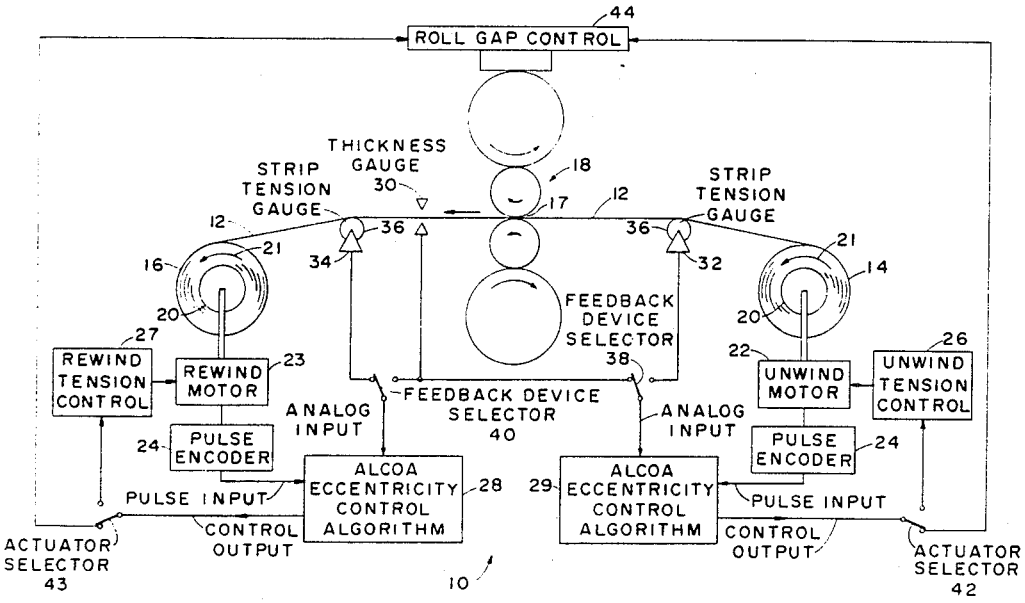

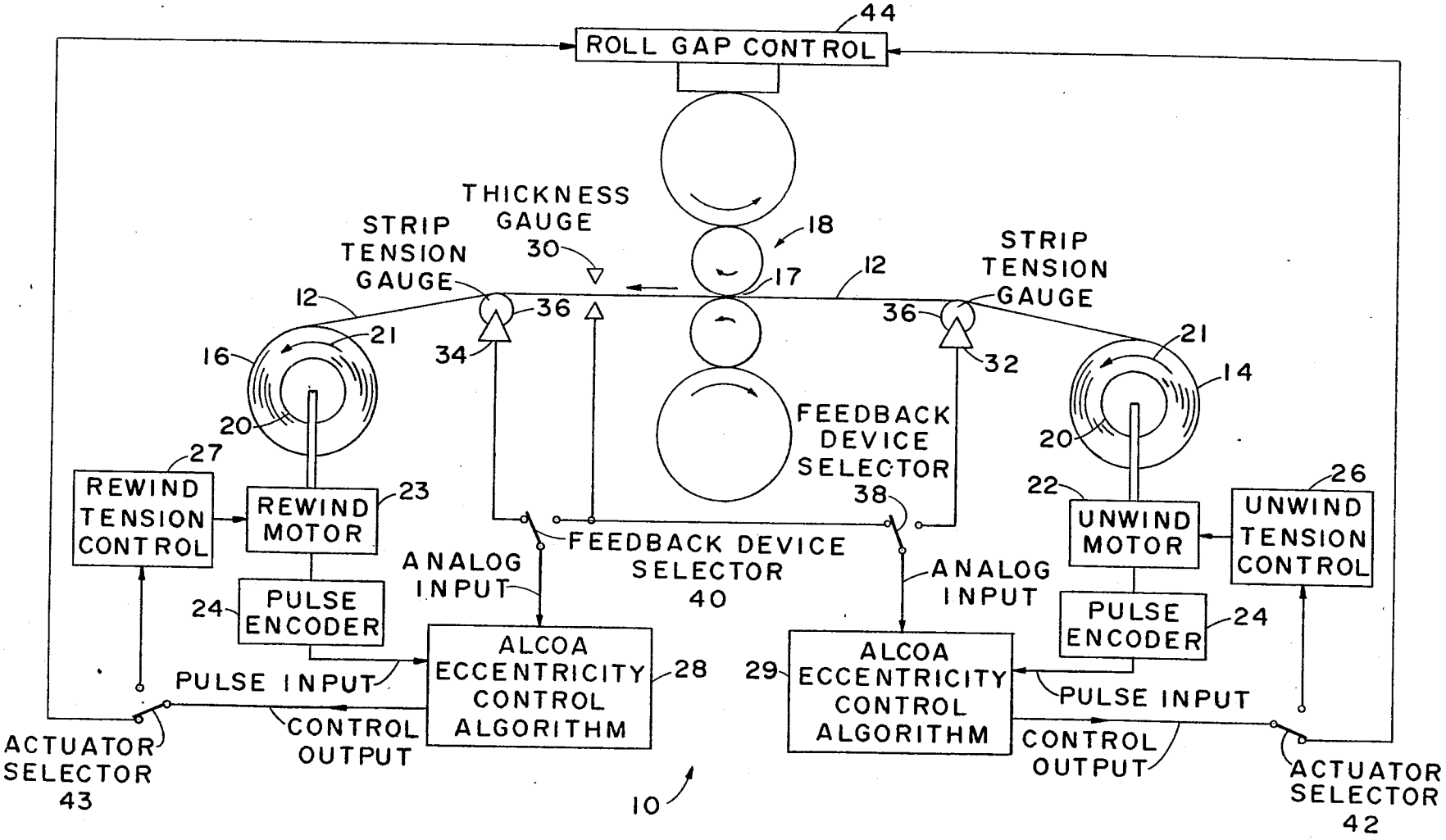
ROLL GAP CONTROL
44
18
17
12
STRIP TENSION GAUGE
36
32
THICKNESS GAUGE
30
STRIP TENSION GAUGE
34
FEEDBACK DEVICE SELECTOR
38
FEEDBACK DEVICE SELECTOR
40
ANALOG INPUT
ANALOG INPUT
ALCOA ECCENTRICITY CONTROL ALGORITHM
29
ALCOA ECCENTRICITY CONTROL ALGORITHM
28
10
UNWIND TENSION CONTROL
26
UNWIND MOTOR
22
PULSE ENCODER
24
PULSE INPUT
CONTROL OUTPUT
ACTUATOR SELECTOR
42
14
21
20
REWIND MOTOR
23
PULSE ENCODER
24
PULSE INPUT
CONTROL OUTPUT
REWIND TENSION CONTROL
27
16
ACTUATOR SELECTOR
43

UNWIND/REWIND ECCENTRICITY CONTROL FOR ROLLING MILLS

BACKGROUND OF THE INVENTION

The present invention relates generally to directing metal strip or sheet from a coil of the strip to and collecting metal strip from a rolling mill as a coil of the strip. More particularly, the invention relates to offsetting the effects of cyclic disturbances originating in a coil of metal being directed to or received from a rolling mill.

In most operations in which metal is rolled in a rolling mill, the uniformity of the thickness of the metal exiting the mill is adversely affected by cyclic disturbances of rotating coils of metal being unwound and directed to the mill, and rewound into a coil, as the metal is collected from the mill. The cyclic disturbances of the coils have frequencies that coincide with the fundamental frequency and harmonics thereof of the coil rotation.

The cause of the problem is fourfold, i.e., cyclic disturbances are caused by (1) dimensional abnormalities (ovalness and eccentricity) of the coils, (2) a resonance condition resulting from a mass/spring system exhibited by the coil being connected to the mill via the strip of material being unwound or rewound, which material is under tension, (3) mechanical friction or binding of the unwind or rewind drive systems, and (4) changes in the thickness of the strip caused by a previous rolling operation that experiences one or more of the above three conditions.

SUMMARY OF THE INVENTION

It has been discovered that variations in the thickness of metal strip entering and/or leaving a rolling mill resulting from cyclic conditions associated with coils of the strip that can be substantially reduced, if not eliminated all together, by direct application of the eccentricity control algorithm disclosed in U.S. Pat. Nos. 4,222,254, 4,531,392, 4,648,257, and 4,656,854 to King et al, Puda, Oliver et al and Stewart et al respectively. The disclosures of these patents are incorporated herein by reference.

In the present invention, a pulse encoder is mechanically connected to each of the unwind and rewind coils such that each encoder provides a certain number of pulses per respective coil revolution, as required by the above algorithm. The algorithm uses the pulse inputs from the encoder to clock the sampling of analog feedback devices, such as an X-ray thickness gauge or a load cell that measures variations in strip tension as the strip enters or leaves a mill. The output of the algorithm is a cyclic compensation signal having frequencies that are equal to the coil frequency and its harmonics. The output is properly phased to cancel variations in thickness of the strip. This is accomplished by directing the output of the algorithm to the system that controls the rolling gap to directly offset gauge variations, or to respective tension controllers to eliminate variations in strip tension that cause variations in gauge.

It is therefore an objective of the invention to eliminate cyclic disturbances in the gauge of a strip or sheet of metal caused by cyclic disturbances in unwind and/or rewind coils of the strip that direct the strip to or receive strip from a rolling mill.

THE DRAWING

The objectives and advantages of the invention will be best understood from consideration of the following detailed description and the accompanying drawing, the sole FIGURE which shows schematically a system for cancelling the effects of cyclic disturbance on the gauge of rolled strip, the disturbances originating with coils of the strip.

PREFERRED EMBODIMENT

Referring now to the FIGURE, a system 10 is shown for offsetting the effects of cyclic variations in the gauge of a metal strip 12, the variations originating with unwind and rewind coil stands 14 and 16 of the strip. As shown, the strip is directed from coil stand 14 to a rolling mill 18. The strip is directed from 18 to coil stand 16. The strip is reduced in thickness in a working gap 17 of mill 18.

Throughout the remaining description and discussion of the invention all subsequent reference numerals will refer to components depicted in the sole FIGURE of the drawing.

As discussed earlier, the shape of coils 14 and/or 16 may be oval and eccentric. Depending upon the type of mill 18 employed to roll strip 12, the strip is wound on either a mandrel or on a hollow spool 20. If a spool is used, cone shaped structures are moved into the hollow of the spool to engage the spool for rotation. In either case, the mandrels or spools, and any cones that may be used, may not be perfect circles so that eccentric moments appear in the coil of material wound on mandrels or spools.

When the strip is started on a mandrel or spool, in the coiling process, the starting end of the strip has a thickness and/or an out-of-flat condition that causes a bump or disturbance in subsequent layers of the strip, as they are wound on the mandrel. This bump is another cause of eccentricity in the coil.

Another problem is the above mentioned mass-spring system of the coil and strip. A coil of metal obviously has a certain mass, and the strip of metal that extends between the coil and mill in the rolling process is under tension. The combination of coil mass and strip tension creates a spring system that has a resonance condition at a certain frequency, i.e., the frequency determined by the coil mass the spring constant of the strip. If the frequency of the cyclic disturbance associated with the coil is that of or near to the resonant condition of the mass-spring system of the coil and strip, the cyclic disturbance will cause the mass-spring system to resonate, i.e., to create standing mechanical waves in the strip extending between the fixed ends of the strip, i.e., at the locations of the mill and coil stands.

A further problem is concerned with systems that drive the coils. Each coil stand includes a motor 22 or 23 and gearing boxes, bearings, and clutches (not shown). These serve to drive the mandrel or spool on which the strip of metal is coiled at an appropriate speed, i.e., a speed that ensures appropriate tension on a strip as it travels to and/or from the mill. The motors themselves may not drive the coils at constant speeds, and clutches and gearing offer opportunities for changes in mechanical friction and binding that can vary the tension of the strip. Bearings wear, of course, as do gears. Tolerances in bearings and gears create disturbances in driving the coils that cyclically change the tension of the strip in traveling to and/or from the mill. Such changes in tension are reflected in changes in the thickness of the material 12 exiting mill 18 and collected at 16. (Arrows 21 on coils 14 and 16 show the direction at which the strip passes through the mill).

The arrangement generally designated by numeral 10 in the drawing represents schematically a method and apparatus that operates to compensate for changes in strip tension and changes in exit gauge caused by changes in strip tension. More particularly, the unwind and rewind motors 22 and 23 shown in the drawing are each provided with a pulse encoder 24. The encoders are mechanically connected to the motors in a manner that causes the encoders to output a series of pulses for each revolution or partial revolution in the coil. The motors, in addition, are provided respectively with electrical means 26 and 27 that control the speeds of the motors in relation to the speed of the mill. Such means can be electrical controllers which are generally commercially available.

As described below, controllers 26 and 27 can be employed to control tension in strip 12 in a manner that offsets the effects of cyclic disturbances in strip tension.

Encoders 24 output electrical pulses to respective eccentricity control algorithms 28 and 29 of the type disclosed in the above patents. As described in the above cited King et al patent, each pulse from such an encoder represents a rotational position increment of a coil such that, in the present case, each increment is represented by a pulse from the encoders. These rotational positions are employed in 28 and 29 to sample the outputs of analogue devices such as a strip thickness gauge 30 or strip tension gauges 32 and 34 so that when each is read by the algorithms the rotational position of the coils will be known relative to their eccentricity or other problem in the coil stand that is causing cyclic changes in strip tension and gauge. Gauge 30 can be an X-ray device, for example, and is located to measure the thickness of strip 12 exiting mill 18, including cyclic changes in thickness. Gauges 32 and 34 are load cells that are part of roller devices 36 that engage the strip, as it travels to and from the mill, in a controlled manner so that the strip is generally always under an appropriate tension in the process of being reduced in thickness by the mill. Cyclic changes in strip tension are measured by load cells of 32 and 34.

The outputs of 30, 32 and 34 are shown conducted to two selector means 38 and 40, i.e., the output of thickness gauge 30 is directed to both selector means, while the outputs of load cells 32 and 34 are directed respectively to selectors 38 and 40.

Similarly, two selectors 42 and 43 are provided to receive respectively the outputs of algorithms 28 and 29, and direct the outputs to tension control devices 26 and 27 or to roll gap control 44.

As shown in the figure of the drawing, selector means 38 is positioned to have algorithm 29 receive the output of thickness gauge 30, while selector means 40 is positioned to have the output of load cell 34 directed to algorithm 28. In this manner, algorithm 29 well receive measurements of strip thickness exiting mill 18 while algorithm 28 will receive measurements of the tension of the strip exiting the mill. Selectors 42 are positioned in the figure to direct the outputs of the algorithms to an actuator 44 that controls the working gap of mill 18.

The operation of system 10 will now be described with selector means 38, 40, 42, and 43 positioned in the manner shown in the figure.

Any eccentricity in unwind coil 14 or cyclic problem in the coil stand measurable by thickness gauge 30 will be detected by 30, i.e., any cyclic condition in coil stand 14 that cyclically changes tension of the strip traveling from 14 to stand 18, such that a corresponding cyclic change in the gauge of the strip results, will be measured by thickness gauge 30. Gauge 30 outputs this measure to algorithm 29, which, as explained above, and in the above cited U.S. patents, samples this measurement each time it receives a pulse from encoder 24. Each pulse from 24 is a record of the rotational position of unwind motor 22. Hence, the algorithm will "know" the position of the motor and coil, and thus, the position of changes in tension in strip 12 resulting from coil eccentricity or other cyclic problems in the coil stand. This data is collected by 29 during the period (time) of the rotation of the coil, and converted by the algorithm to a frequency domain signal. This provides the system with the fundamental frequency of the disturbance and any harmonies thereof. These are monitored and separated in 29, and the magnitude and phase angle of the disturbance observed. These components (frequency, magnitude and phase angle) are then employed in an update algorithm of 29, as explained in the above cited patents, to provide a current estimate of the cyclically occurring change in tension and gauge. This estimate is then converted (processed) back to a time-based value, which is employed to correct for the changing gauge of strip 12 by controlling the working gap 17 of mill 18. As shown in the figure, the output of 29 is directed through selector 42 to a gap control actuator 44. Actuator 44 cyclically changes gap 17 in a manner that offsets the effects of cyclic tension in 12, as 44 receives the output of 29 under control of encoder 24. The cyclic effects of coil 14 on the gauge of the strip exiting stand 18 is thereby cancelled; the strip exits 18 with a constant gauge. If selector 38 is changed to direct strip tension measurements to 29, the algorithm then controls actuator 44 in response to the changes sensed by load cell 32. Similarly, if selector 42 is changed to direct the output of 29 to controller 26, the algorithm of 29 can offset the effects of coil eccentricity by cyclically changing the speed of motor 22.

While the above operation is going on under the control of algorithm 29, load cell 34 is sensing the tension of the strip exiting the mill and being wound on rewind coil 16. If this coil is exhibiting eccentricity, the tension exiting the mill will be cyclic, and the cyclic phenomenon can, again, produce a cyclic change in the gauge of strip 12 exiting the mill. As with algorithm 29, algorithm 28 functions to sample any change in the tension of the strip traveling between 18 and 16, and accordingly, signals actuator 44 to cyclically alter the gap of the mill in a manner that offsets the effects of the eccentricity of coil 16 on the gauge of strip 12.

Algorithm 28 can, however, do the same thing by controlling rewind tension, as opposed to strip gauge. In such a case, selector 43 is changed to direct the output of 28 to tension controller 27. Controller 27 controls the speed of rewind motor 23 in a manner that maintains tension on strip 12 constant by cyclically changing tension in a phase opposite the changing tension caused by the eccentricity of coil 16.

Similarly, if selector 40 is positioned to direct thickness measurements from gauge 30 to algorithm 28, 28 can control either rewind tension or mill gap, depending on the position of selector 43, on the bases of the sensed gauge of strip 12 exiting the mill.

What is claimed is:

1. A method of rolling material in a rolling mill, comprising directing the material to the rolling mill from an unwind coil of the material and through the mill to a rewind coil of the material, the material being under tension as it is being directed to and from the mill, said unwind and rewind coils and associated drive means being capable of producing cyclic disturbance that ordinarily causes a cyclic change in the tension of the material and in the thickness of the material exiting the mill and collected on the rewind coil, measuring the change in tension and/or thickness, providing time domain samples of the change during revolution of the unwind or rewind coil, processing the samples by characterizing them as frequency, magnitude and phase angle components of the change using a function that transforms the time domain of the samples to a frequency domain, using said components in an update algorithm to provide a current estimate of the disturbances processing the current estimate in a manner that returns the same to a time domain value, using the time domain value to correct for the effects of the cyclic change by controlling the working gap of the mill in a manner that offsets the occurrence of the cyclic change in material tension and thickness caused by one or both of the coils if material thickness is being measured, and controlling the tension of the material by changing the rate at which the material is directed to or from the mill by the unwind or rewind coils respectively in a manner that offsets the occurrence of cyclic change if material tension is being measured.

2. A method of controlling a rolling mill receiving material to be rolled from an unwind coil of the material, which coil includes means for driving the same in a manner that maintains the material between the mill and coil in tension, the unwind coil producing a cyclic disturbance in said tension, the method comprising measuring cyclic change in the tension caused by said cyclic disturbance, providing time domain samples of the cyclic change during a time period defined by a revolution or multiples thereof the unwind coil, processing said samples by characterizing them as frequency, magnitude and phase angle components of the change, using said components to update an update algorithm to provide a current estimate of the cyclic change, processing the current estimate in a manner that returns the estimate to a time domain value, and using said time domain value to correct for the cyclic disturbance by changing the speed of the drive means in synchronism with cyclic disturbance to offset the effects of said cyclic disturbance on the tension of the material.

3. The method of claim 2 in which the cyclic disturbance is caused by eccentricity of the unwind coil.

4. The method of claim 2 in which the cyclic disturbance is caused by mechanical friction or binding of the drive means.

5. The method of claim 2 in which the cyclic disturbance is caused by a resonance condition resulting from the mass of the coil in combination with the resilience of the material under tension between the mill and the unwind coil such that a mass-spring system is created.

6. A method of controlling a rolling mill directing material rolled in the mill to a rewind coil of the material, which coils includes means for driving the same in a manner that maintains the material between the mill and coil in tension, the rewind coil producing a cyclic disturbance that causes a cyclic change in said tension, the method comprising measuring cyclic change in the tension caused by said cyclic disturbance, providing time domain samples of the cyclic change during a time period defined by a revolution or multiples thereof of the rewind coil, processing said samples by characterizing them as frequency, magnitude and phase angle components of the change, using said components to update an update algorithm to provide a current estimate of the change, processing the current estimate in a manner that returns the estimate to a time domain value, and using said time domain value to correct for the cyclic disturbance by changing the speed of the drive means in synchronism with cyclic disturbance to offset the effects of the cyclic disturbance on the tension of the material.

7. The method of claim 6 in which the cyclic disturbance is caused by eccentricity of the rewind coil.

8. The method of claim 6 in which the cyclic disturbance is caused by mechanical friction or binding of the drive means.

9. The method of claim 6 in which the cyclic disturbance is caused by a resonance condition resulting from the mass of the rewind coil in combination with the resilience of the material under tension between the mill and the rewind coil such that a mass-spring system is created.

* * * * *